US009533340B2

(12) United States Patent
Morlo et al.

(10) Patent No.: US 9,533,340 B2
(45) Date of Patent: Jan. 3, 2017

(54) PRODUCTION METHOD FOR STAMPED PARTS AND APPARATUS

(75) Inventors: Ralf Morlo, Saarbrucken (DE); Reinhold Neumann, Riegelsberg (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 862 days.

(21) Appl. No.: 13/084,652

(22) Filed: Apr. 12, 2011

(65) Prior Publication Data

US 2011/0265541 A1 Nov. 3, 2011

(30) Foreign Application Priority Data

Apr. 28, 2010 (DE) ..... 10 2010 028 280

(51) Int. Cl.
*B21D 35/00* (2006.01)
*B21D 28/16* (2006.01)

(52) U.S. Cl.
CPC ..... *B21D 35/00* (2013.01); *B21D 28/16* (2013.01)

(58) Field of Classification Search
CPC ..... B21D 51/44; B21D 28/06; B21D 13/02; B21D 13/04; B21D 53/00; B21D 51/24; B21D 5/02; B21D 43/05; B21D 35/00; B21D 28/16; B21F 33/04; H01R 43/042; B21K 27/04; B30B 9/3007; B30B 9/32; B30B 15/08; B30B 9/326; A23N 1/003; A47J 19/022; B26D 5/00; B26D 2005/002
USPC .... 72/329, 330, 336, 337, 404, 405.01, 385, 72/379.6, 338–340, 379.2; 100/35, 39, 100/207, 140, 94, 95, 97, 98 R; 83/39, 40, 82/55, 202, 212.1, 213
See application file for complete search history.

(56) References Cited

U.S. PATENT DOCUMENTS

| | | | | |
|---|---|---|---|---|
| 1,588,057 | A | 6/1926 | Ruckert | |
| 4,736,610 | A * | 4/1988 | Carroll et al. | 72/325 |
| 5,791,186 | A * | 8/1998 | Nishida et al. | 72/337 |
| 6,125,527 | A | 10/2000 | Sunaga et al. | |
| 6,167,601 | B1 * | 1/2001 | Gollhofer et al. | 29/6.1 |
| 6,212,930 | B1 * | 4/2001 | Skrabs et al. | 72/336 |
| 6,638,469 | B2 | 10/2003 | Tane et al. | |
| 7,100,416 | B2 * | 9/2006 | Suzumura et al. | 72/379.2 |
| 7,178,375 | B2 * | 2/2007 | Badour | 72/336 |
| 7,331,874 | B2 * | 2/2008 | Lin | 470/41 |
| 8,365,569 | B2 * | 2/2013 | Frauchiger | 72/336 |
| 2008/0098788 | A1 * | 5/2008 | Taniguchi et al. | 72/336 |

FOREIGN PATENT DOCUMENTS

| | | |
|---|---|---|
| DE | 198 07 845 A1 | 8/1998 |
| DE | 196 08 551 A1 | 8/1999 |
| DE | 197 38 635 C2 | 9/2002 |
| EP | 0 885 074 B1 | 1/2000 |
| EP | 1 128 081 B1 | 10/2008 |

* cited by examiner

*Primary Examiner* — David Bryant
*Assistant Examiner* — Lawrence Averick
(74) *Attorney, Agent, or Firm* — Davis & Bujold, PLLC; Michael J. Bujold

(57) ABSTRACT

A method for producing stamped components in two method steps such that, during the first method step, a workpiece (1) is stamped out or precision-cut and then transported between the first and the second method step. The second method step comprises simultaneously corrugating and deburring the workpiece (1'). The method is carried out using a two-stage tool.

13 Claims, 1 Drawing Sheet

PRODUCTION METHOD FOR STAMPED PARTS AND APPARATUS

This application claims priority from German patent application serial no. 10 2010 028 280.4 filed Apr. 28, 2010.

FIELD OF THE INVENTION

The invention concerns a method for the production of stamped parts and an apparatus for implementing the method.

BACKGROUND OF THE INVENTION

From EP 0 885 074 B1 by the present applicant a method for producing stamped parts, in particular disks, in two method steps has become known. For this, in a first method step a workpiece is stamped out or precision-cut. Precision cutting is a special stamping method by means of which particularly clean cut surfaces can be produced. Precision cutting is described in detail in DE 197 38 635 C2. During the stamping or precision-cutting of the workpiece stamping burrs are produced on the cut surfaces, which then have to be eliminated. For this a second method step is provided in EP 0 885 074 B1, in which the stamping burrs are pressed out, i.e. flattened. The workpiece is transported from the precision-cutting step to the pressing-out step by a transporting grip. Both steps are arranged in one tool.

Disks made by stamping and used for disk clutches or shifting devices in automatic transmissions have a corrugation that extends round the circumference, which is produced in an additional working step. EP 1 128 081 B1 describes a process for producing such corrugated disks. As a rule a disk clutch comprises inner and outer disks, which have inner or outer serrations. The outer disks have corrugations whereas the inner disks are flat. After stamping, the corrugation is produced by means of a corrugating machine comprising deformation tools for forming the corrugation in the flat disk.

SUMMARY OF THE INVENTION

The purpose of the present invention is to propose a production method for stamped components, which enables economical production of stamped and corrugated components. A further objective of the invention is to provide a device which enables the method to be carried out economically, and which is of simple structure and can be made inexpensively. A final purpose of the invention is to propose an advantageous application of the products of the method.

According to the invention, in the two-step method it is provided that the second step includes both the corrugation and the deburring of the workpiece. In this way two working steps, which in the prior art are carried out one after the other and on different machines, are now carried out simultaneously. This shortens the production time and reduces manufacturing costs.

According to an advantageous feature, the deburring is carried out by pressing down the stamping burrs produced on the workpieces by the prior precision cutting. Pressing down has the advantage that no additional swarf is generated, and is therefore a clean process.

According to a further advantageous feature the first and second method steps, i.e. the precision cutting and the pressing and corrugating, are carried out in one working stroke of the tool. In this way the number of finished components can be increased.

According to the invention a two-operation tool is provided in a device for implementing the method, which has as its first operation a precision-cutting stage and as its second operation a pressing and corrugating stage. In this way the stamped components can be made using one tool, with transport from the first to the second stage preferably effected by means of a transporting device.

In a preferred embodiment the two-stage tool has a lower part and an upper part, such that either the lower or the upper part can move to carry out a working stroke. This gives the advantage that the two method steps, i.e. on the one hand the precision cutting and on the other hand the pressing and corrugating, are carried out in a single tool stroke. This can increase the number of finished components produced. Investment costs for tooling are ultimately relatively low, since the two steps are integrated in one tool.

According to the invention the stamped components made in accordance with the invention are used as disks of the type preferably used in disk clutches or shifting devices of automatic transmissions for motor vehicles. Since such disks are produced in very large numbers, shorter production times by virtue of the method and low investment costs thanks to the device are very advantageous.

BRIEF DESCRIPTION OF THE DRAWINGS

Example embodiments of the invention are illustrated in the drawing and described in more detail below; further characteristics and/or advantages can be seen from the drawing and/or the description. The drawings show.

DETAILED DESCRIPTION OF THE PREFERRED EMBODIMENTS

Figures 1A, 1B:
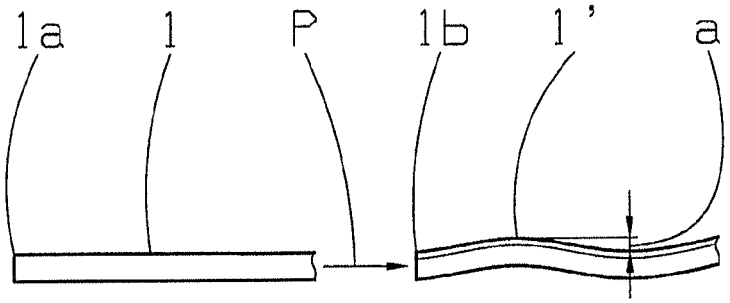
FIG. 1*a*: A stamped component after the first method step.
FIG. 1*b*: A stamped component after the second method step.

FIGS. 1*a* and 1*b* show, respectively, a workpiece 1 after a first method step and the workpiece 1' after a second method step. The method according to the invention serves to produce stamped components, in particular corrugated disks of the type used in disk clutches or shifting devices for automatic transmissions of motor vehicles. The method according to the invention comprises two method steps, namely firstly stamping or precision-cutting, which is a special variant of stamping, and secondly simultaneous pressing and corrugating, during which the pressing, also called impressing, is a deburring process.

FIG. 1*a* shows the workpiece 1, i.e. a flat disk after precision-cutting, in which an outer contour and sometimes an inner contour are cut out from a raw material. During precision cutting a stamping burr, indexed 1*a*, is produced.

FIG. 1*b* shows the workpiece 1' after carrying out the second method step. During this step the stamping burrs 1*a* shown in FIG. 1*a* have been pressed down, producing a slightly rounded edge 1*b*. The workpiece 1' is also corrugated over an amplitude a as indicated, i.e. the distance between the peak and trough of the corrugation is a. The first and second method steps are carried out in different positions, i.e. after carrying out the first method step, the workpiece 1 is moved to an adjacent position, as indicated by the arrow P.

Figure 2:
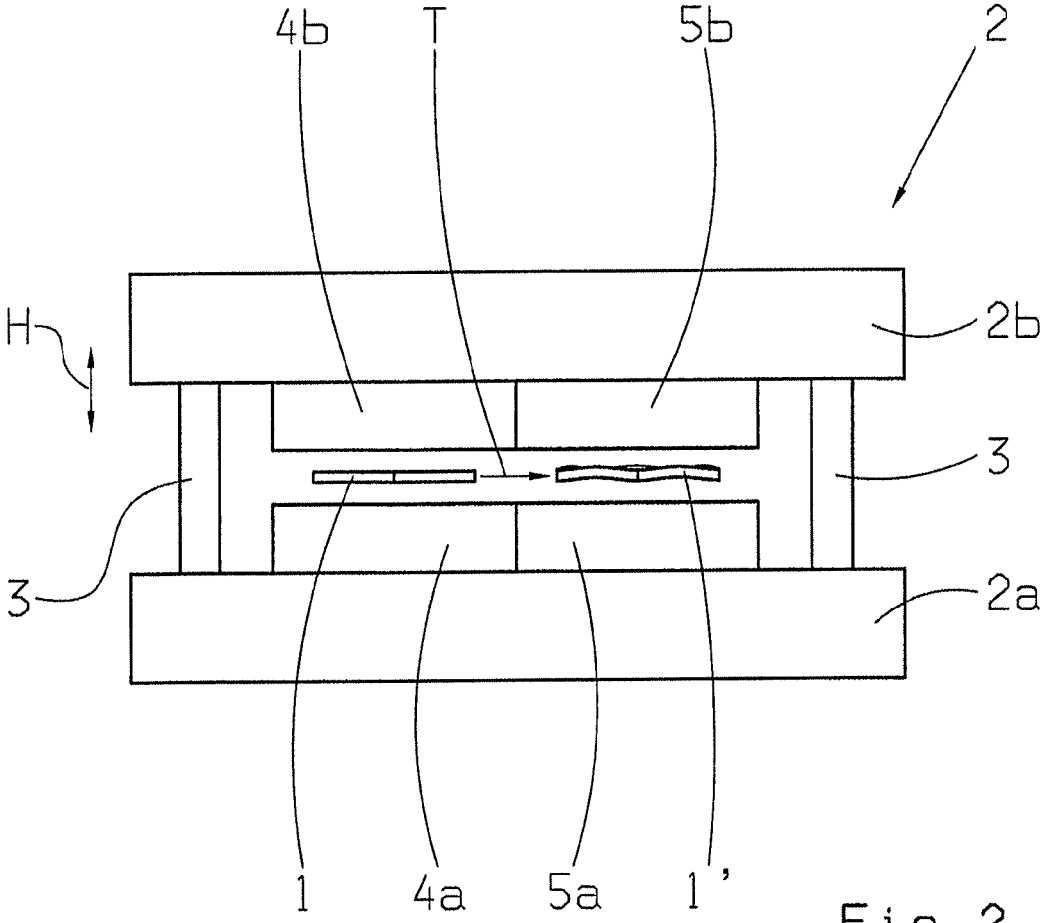
FIG. 2: A device for implementing the method according to the invention

To clarify the method according to the invention further, FIG. 2 shows a device 2, also referred to as a tool 2, using which the method according to the invention can be implemented. The device 2 comprises a positionally fixed lower part 2*a* and a moving upper part 2*b* which is guided on columns 3 so as to carry out a working stroke in the direction shown by a double arrow H. The tool 2 involves two stages 4*a*, 4*b* and 5*a*, 5*b*, i.e. it has two stations through which the workpiece 1, 1' passes. The first stage or station 4*a*, 4*b* is a precision-cutting step and the second stage 5*a*, 5*b* includes the simultaneous deburring and corrugating of the workpiece 1'. The workpiece 1 is transported from the precision-cutting stage 4*a*, 4*b* to the second stage 5*a*, 5*b* by a transporting device (not shown, and indicated only by an arrow T), preferably a transporting grip. The first method step, namely the precision cutting, and the second method step, deburring and corrugating, take place simultaneously, i.e. with one working stroke of the upper part 2*b* of the tool, to which the upper tools 4*b*, 5*b* for the respective stages are attached. The feeding in of raw (starting) material (not shown) and the ejection of the finished component 1' take place simultaneously.

Otherwise than in the example embodiment illustrated and described above, it is also possible for the upper part of the tool to be static and for the lower part of the tool to be mobile in order to carry out the working stroke.

INDEXES

1 Workpiece (stamped)
1*a* Stamping burr
1*b* Deburred edge
2 Tool
2*a* Lower part of tool
2*b* Upper part of tool
3 Column
4*a* First stage (bottom)
4*b* First stage (top)
5*a* Second stage (bottom)
5*b* Second stage (top)
a Corrugation amplitude
P Transport direction
H Stroke direction
T Transport device

The invention claimed is:

1. A method of producing stamped components for inner and outer disks of a disk clutch in two method steps, the method comprising the steps of:

either stamping out or precision-cutting of a flat workpiece (1) from a starting material with a single tool, during a first method step, to form and separate the flat workpiece from the starting material, and the flat workpiece having a top surface and a bottom surface, and transporting the flat workpiece (1) between the first method step and a second method step, and simultaneously corrugating and debarring the flat workpiece to form a finished workpiece (1') with the tool, during the second method step, such that the top surface of the finished workpiece has a waveform profile and the bottom surface of the finished workpiece has a waveform profile that are coincident with each other when viewed in profile.

2. The method according to claim 1, further comprising the step of debarring the flat workpiece by pressing down stamping burrs (1*a*) on the flat workpiece, and simultaneously corrugating the flat workpiece during the second method step such that the waveform profile of the top and the bottom surfaces of the finished workpiece comprise peaks and troughs when the finished workpiece is viewed in profile, and the peaks and the troughs of the waveform profile of the top surface are coincident with the peaks and the troughs of the waveform profile of the bottom surface, when viewed in profile, and the peaks and the troughs of the waveform profiles of the top and the bottom surfaces are separated by an amplitude dimension when viewed in profile.

3. The method according to claim 1, further comprising the step of carrying out the first method step on the starting material and the second method step on the flat workpiece during a single working stroke (H) of the tool, the flat workpiece being independent of the starting material before transporting the flat workpiece between the first method step and the second method step.

4. The method according to claim 1, further comprising the step of manufacturing disks as the stamped components, shaping the flat workpiece such that the top and the bottom surfaces of the finished workpiece have matching waveform profiles comprising corresponding peaks and troughs, the peaks and the troughs of at least the top surface are spaced from each other, when viewed in profile, and define an amplitude dimension of the workpiece, and using the finished workpieces as the disks of shifting devices within a motor vehicle transmission.

5. The method according to claim 1, further comprising the step of deburring the flat workpiece by pressing down stamping burrs (1*a*) on the flat workpiece, and an outer circumferential surface of the finished workpiece when viewed in profile, extends from an edge of the top surface to an edge of the bottom surface.

6. The method according to claim 1, further comprising the step of simultaneously carrying out the first method step, on raw material to form and separate another flat workpiece (1) from the raw material, and the second method step, on a previously formed flat workpiece (1'), during a single working stroke (H) of the two stage tool (2).

7. The method according to claim 1, wherein the single tool has a fixed part and a moving part that moves along columns, movement of the moving part from a first position remote from the fixed part to a second position adjacent the fixed part and return movement back to the first position is defined as a working stroke of the tool, the fixed part of the tool has first and second stages that are secured to the fixed part so as to be adjacent each other in a direction of movement of the flat workpiece, and the moving part of the tool has first and second stages that are secured to the moving part so as to be adjacent each other in the direction of movement of the flat workpiece, the first stage of the fixed part is aligned with the first stage of the moving part in a direction of movement of the moving part and the second stage of the fixed part is aligned with the second stage of the moving part in the direction of movement of the moving part, the method further comprising the steps of:

locating the flat workpiece between the first stages of the fixed part and the moving part and locating a prior stamped flat workpiece between the second stages of the fixed part and the moving part; and moving the moving part through a single working stroke so as to simultaneously stamp out and form another prior stamped flat workpiece, and simultaneously corrugate and deburr the prior stamped flat workpiece by pressing down stamping burrs on the prior stamped flat workpiece to provide the top surface and the bottom surface of the finished workpiece with coincident waveform profiles having corresponding peaks and troughs when viewed in profile.

8. The method according to claim 1, further comprising the step of positioning the starting material in a first position with respect to the tool for the first method step of stamping out or precision-cutting of the flat workpiece, transporting the flat workpiece from the first position to a second position with respect to the tool, and the flat workpiece being arranged in the second position throughout the second method step of simultaneously corrugating and deburring the flat workpiece to form the finished workpiece.

9. A device for producing stamped components in a two step method that includes a first step of stamping out and precision-cutting of a flat workpiece (1) from a starting material such that the flat workpiece is independent of the starting material prior to transporting the flat workpiece (1), between the first step and a second step of simultaneously corrugating and deburring the flat workpiece to form a finished workpiece (1'), the device comprising:

a two-stage tool (2, 2*a*, 2*b*) having a first stage comprising a precision-cutting stage (4*a*, 4*b*) and a second stage comprising a simultaneous pressing and corrugating stage (5*a*, 5*b*), the second stage comprising an upper tool and a lower tool which press the flat workpiece therebetween such that top and bottom surfaces of the finished workpiece each have a waveform profile.

10. The device according to claim 9, wherein the two-stage tool (2) comprises a device (T) for transporting the flat workpiece (1) from the first stage (4*a*, 4*b*) to the second stage (5*a*, 5*b*).

11. The device according to claim 9, wherein the two-stage tool (2) comprises a lower part (2*a*) and an upper part (2*b*), the lower tool and the upper tool being respectively fixed to the lower part and the upper part, one of the lower and the upper parts (2*a*, 2*b*) is fixed in position and the other of the lower and the upper parts (2*a*, 2*b*) is movable in relation thereto to perform a working stroke of the two-stage tool.

12. The device according to claim 9, wherein the flat workpiece is stamped out and precision cut during the first method step from the starting material that is arranged in a first position in the two-stage tool, the flat workpiece is transported from the first position to a second position in the two-stage tool, the flat workpiece remaining in the second position in the two-stage tool throughout the second method step of simultaneously corrugating and deburring the flat workpiece to form the finished workpiece.

13. A method of producing stamped components, the method consisting of:

one of stamping out and precision-cutting to form and separate a flat workpiece (1) from a starting material, during a first method step of a first stage (4*a*, 4*b*) of a two stage tool (2), and transporting the flat workpiece (1) from the first stage (4*a*, 4*b*) of the two stage tool (2) to a second stage (5*a*, 5*b*) of the two stage tool (2); and simultaneously corrugating and deburring the flat workpiece (1'), during a second method step of the second stage (5*a*, 5*b*) of the two stage tool (2) to form a finished workpiece comprising corrugations from the flat workpiece, such that top and bottom surfaces of the finished workpiece each have a common waveform profile and comprise peaks and troughs, the waveform profile of the top surface and the waveform profile of the bottom surface match each other such that the peaks of the top surface align with the peaks of the bottom surface and the troughs of the top surface align with the troughs of the bottom surface, and the peaks and the troughs of at least the top surface are spaced from each other, when viewed in profile, and define an amplitude dimension of the finished workpiece.

* * * * *